US005423256A

United States Patent [19]

Villarreal et al.

[11] Patent Number: 5,423,256

[45] Date of Patent: Jun. 13, 1995

[54] FORM ROLLER FOR PRINTING PRESS

[76] Inventors: Jose A. Villarreal; Gary D. Southerland, both of 4824 Vicksburg St., Dallas, Tex. 75207

[21] Appl. No.: 192,337

[22] Filed: Feb. 7, 1994

[51] Int. Cl.[6] ..... B41F 31/00

[52] U.S. Cl. ..... 101/349; 101/219; 101/216; 101/350

[58] Field of Search ..... 101/148, 216, 219, 348, 101/349, 350, 351, 352, 481

[56] References Cited

U.S. PATENT DOCUMENTS

| | | | |
|---|---|---|---|
| 3,389,449 | 6/1968 | Fyfe | 101/348 |
| 3,433,155 | 3/1969 | Norton | 101/349 |
| 3,467,008 | 9/1969 | Domotor | 101/350 |
| 4,676,156 | 6/1987 | Aylor et al. | 101/148 |
| 4,724,764 | 2/1988 | MacPhee et al. | 101/148 |
| 4,739,703 | 4/1988 | Eguchi | 101/349 |
| 4,777,877 | 10/1988 | Lemaster | 101/350 |
| 4,785,514 | 11/1988 | Kannwischer | 101/348 |
| 4,809,606 | 3/1989 | Day et al. | 101/349 |
| 4,972,771 | 11/1990 | Weisgerber et al. | 101/352 |
| 5,152,224 | 10/1992 | Guaraldi | 101/350 |
| 5,170,706 | 12/1992 | Rodi et al. | 101/350 |

*Primary Examiner*—Eugene H. Eickholt
*Attorney, Agent, or Firm*—H. Dennis Kelly; Timmons & Kelly

[57] ABSTRACT

An adjustable nut and a friction washer exert a resistance to the rotation of a form roller, causing the form roller to rotate slower than the plate cylinder. The final form roller thus wipes the plate cylinder free of foreign particles to eliminate hickeys and ghosting on the final print.

11 Claims, 2 Drawing Sheets

FORM ROLLER FOR PRINTING PRESS

BACKGROUND OF THE INVENTION

1. Field of the Invention

This invention relates in general to offset lithographic printing presses. In particular, the invention relates to a lithographic press having an improved form roller.

2. Description of Related Art

An offset lithographic printing press has a cylindrical plate cylinder, on which a negative of the text and illustrations to be printed has been etched by a type of photographic process. Dampening rollers apply water to the plate cylinder, and the water adheres to the plate cylinder, except where the text and illustrations are located.

A series of form rollers, or inking rollers, then apply a layer of ink to the plate roller. The ink adheres to the plate cylinder only where the text and illustrations are located.

The plate cylinder then presses the inked text and illustrations onto a rubber blanket cylinder. An impression cylinder then presses a sheet of paper against the blanket cylinder as the paper passes between the blanket cylinder and the impression cylinder. The inked text and illustrations on the blanket cylinder are transferred onto the paper.

The series of form rollers may include vibrators or oscillating rollers that are cooled to chill the ink and prevent moisture loss. The vibrators also oscillate back and forth to pass the ink evenly to the form rollers.

Sometimes, impurities or clumps of ink on the vibrators will cause the ink to be spread unevenly onto the form rollers. This causes small dots, or hickeys, to appear on the paper. An apparatus was needed to eliminate these unwanted hickeys.

SUMMARY OF THE INVENTION

The general object of the form roller of the invention is to wipe the plate cylinder to cause the ink to be spread more evenly, thus eliminating unwanted hickeys and ghosting on the paper. In general, this object is accomplished by exerting a resistance against the rotation of the form roller, causing the form roller to rotate slower than the vibrator. Therefore, as the vibrator rotates against the form roller, the slower rotating form roller will wipe the surface of the vibrator, causing the ink to be spread more evenly.

The above, as well as additional objects, features, and advantages of the invention will become apparent in the following detailed description.

DESCRIPTION OF THE PREFERRED EMBODIMENT

Figure 1:
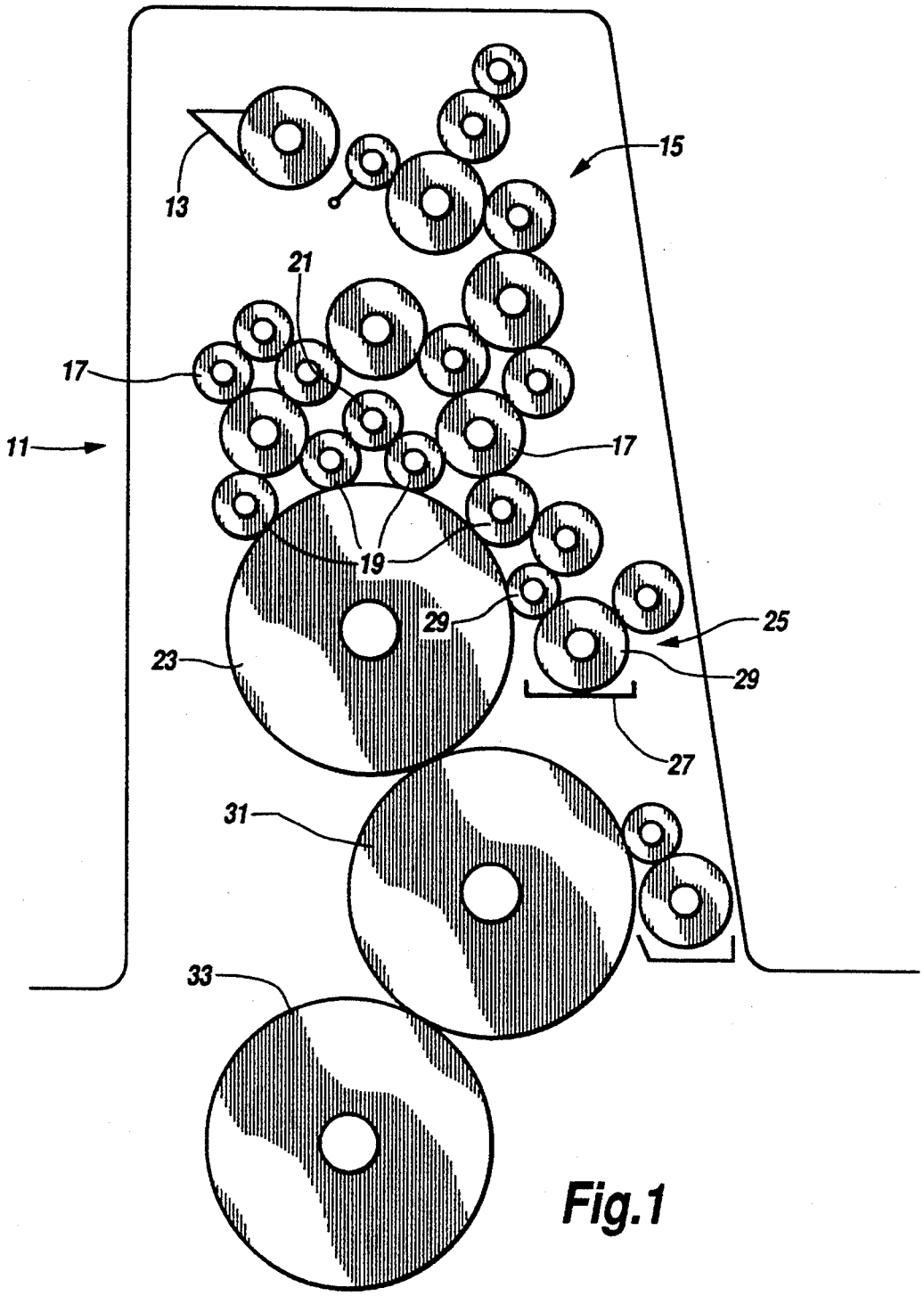
FIG. 1 is a schematic drawing of an offset lithographic printing press having form rollers according to the invention.

FIG. 1 illustrates the workings of a typical offset lithographic printing press 11. Ink is stored in an ink tray 13 near the top of the press 11.

The ink flows downward through a series of rollers 15 to a pair of vibrators 17, also know as oscillating rollers. The rollers 15 and the vibrators 17 are cylindrical and have parallel longitudinal axes. The vibrators 17 oscillate back and forth along their longitudinal axes to spread the ink evenly. In some cases, the vibrators 17 may be cooled to chill the ink.

The vibrators 17 deliver the ink to a set of ink form rollers 19 mounted in the press 11. These final form rollers 19 may also contact a bridge roller 21.

The final form rollers 19 are mounted in the press 11 in contact with a plate cylinder 23. These final form rollers 19 are thus mounted between the vibrators 17, the bridge roller 21, and the plate cylinder 23. The final form rollers 19 transfer the ink to the plate cylinder 23.

A dampening system 25 is mounted in the press 11 to apply water to the plate cylinder 23. The dampening system 25 includes a water tray 27 and a series of rollers 29 between the tray 27 and the plate cylinder 23.

The plate cylinder 23 rolls against a blanket cylinder 31, and the blanket cylinder 31 rolls against an impression cylinder 33. The impression cylinder 33 pushes the paper against the blanket cylinder 31 to cause ink to be transferred from the blanket cylinder 31 to the paper as the paper passes between the blanket cylinder 31 and the impression cylinder 33.

Figure 2:
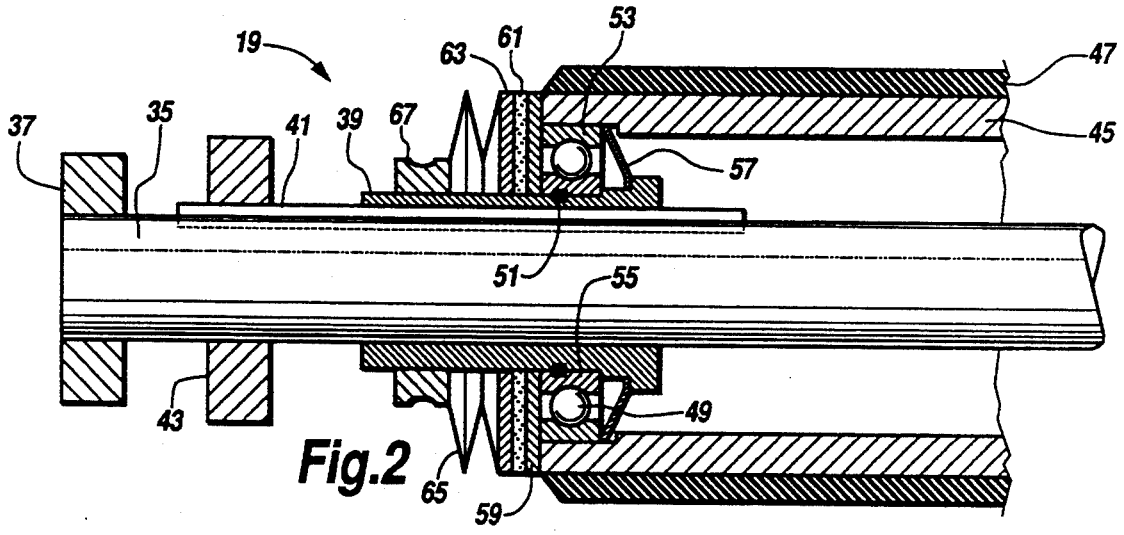
FIG. 2 is a sectional view of the form roller of the invention, shown with the roller in the far right position.
Figure 3:
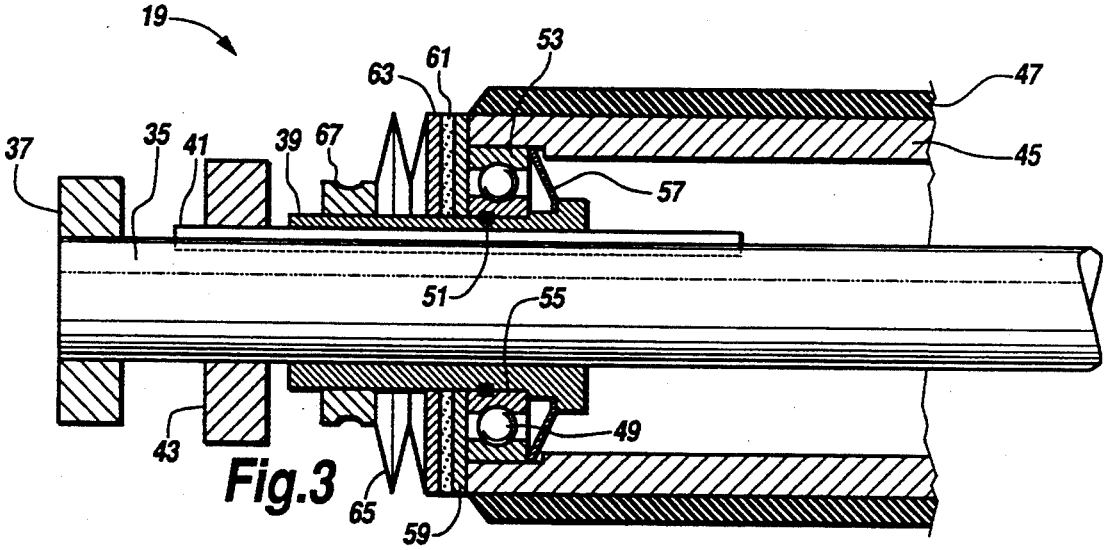
FIG. 3 is a sectional view of the form roller of the invention, shown with the roller in the far left position.

FIGS. 2 and 3 illustrate one embodiment of the invention. This embodiment is designed for final form rollers 19 that are in contact with oscillating vibrators 17. These form rollers 19 include a non-rotating shaft 35 with a bearing spacer 37 on each end. The bearing spacers 37 are attached to the press 11 to replace the rotating shaft of a prior art form roller.

A pair of cylindrical bushings 39 are mounted around the shaft 35. Each bushing 39 is engaged by a linear key 41 that allows the bushing 39 to slide back and forth along the shaft 35, but does not allow the bushing 39 to rotate. A stop 43 on the key 41 prevents the bushing 39 from sliding beyond a particular point.

Each form roller 19 has a cylindrical core 45, covered with a cover 47. The core 45 is preferably made of a metal, such as steel, and the cover 47 is made of a rubber material, such as neoprene. Other materials may be used for different applications.

A roller bearing 49 is mounted on each end of the form roller 19, attached to the core 45 with a retaining ring 51. The outer race 53 of the bearing 49 rotates with the core 45, while the inner race 55 is non-rotating and abuts the bushing 39. A spring back-up washer 57 is located between a shoulder on the bushing 39 and the outer race 53 of the roller bearing 49.

A back-up washer 59 is located at each end of the core 45. The back-up washer 59 is pinned or otherwise connected to the core 45, and rotates with the core 45.

A friction washer 61 is located on the outer side of each of the back-up washers 59. The friction washer 61 is not connected to the back-up washer 59, but is allowed to rotate independently.

Outside of each friction washer 61, a second back-up washer 63 is mounted on the bushing 39. This second back-up washer 63 is not connected to the friction washer 61, and does not rotate.

A spring washer 65 is located outside of each of the second back-up washers 63. The spring washer 65 does not rotate.

A tension nut 67 is threaded onto each bushing 39 outside the spring washers 65. Therefore, the roller bearing 49, the back-up washer 59, the friction washer 61, the second back-up washer 63, and the spring washer 65 are held together between the spring back-up washer 57 and the tension nut 67. The tension nut 67 can be rotated to increase or decrease the tension placed on the washers 59, 61, and 65 and the core 45. If the tension is very loose, the core 45 will be free to rotate about the inner race 55.

If the tension is very tight, friction between the friction washer 61 and the back-up washer 59 will slow the rotation of the core 45. As the rotation of the core 45 is slowed, the cover 47 will slip on the surface of the plate cylinder 23, thus wiping the plate cylinder 23 free of foreign particles that might cause a hickey.

As the vibrator 17 oscillates back and forth, the ink roller 19 will follow the vibrator 17, and also oscillate. The bushing 39 will move back and forth along the key 41, until the bushing 39 contacts one of the stops 43. The stop 43 prevents any excessive oscillation of the ink roller 19.

Figure 4:
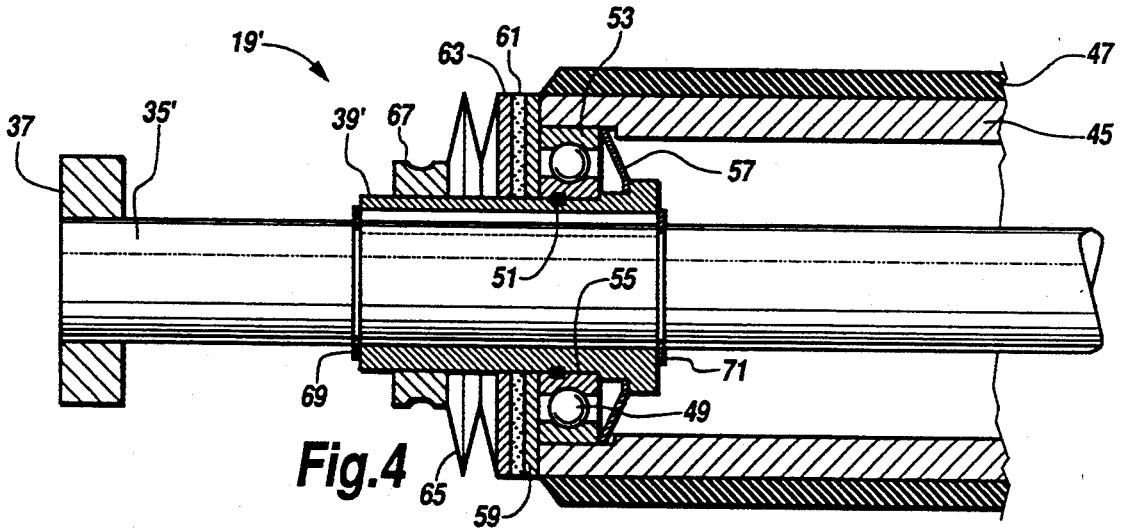
FIG. 4 is a sectional view of an alternate embodiment of the form roller of the invention.

FIG. 4 illustrates a second embodiment of the invention. This embodiment is designed for final form rollers 19' that are in contact with a non-oscillating bridge roller 21. These form rollers 19' include a non-rotating shaft 35' with a bearing spacer 37 on each end. The bearing spacers 37 are attached to the press 11 to replace the rotating shaft of a prior art form roller.

A pair of cylindrical bushings 39' are mounted around the shaft 35'. A pair of retainer rings 69 and 71 hold each bushing 39' in a single location on the shaft 35'. Therefore, this embodiment of the form roller 19' cannot oscillate.

Each form roller 19' has a cylindrical core 45, covered with a cover 47. The core 45 is preferably made of a metal, such as steel, and the cover 47 is made of a rubber material, such as neoprene. Other materials may be used for different applications.

A roller bearing 49 is mounted on each end of the form roller 19', attached to the core 45 with a retaining ring 51. The outer race 53 of the bearing 49 rotates with the core 45, while the inner race 55 is non-rotating and abuts the bushing 39. A spring back-up washer 57 is located between a shoulder on the bushing 39 and the outer race 53 of the roller bearing 49.

A back-up washer 59 is located at each end of the core 45. The back-up washer 59 is pinned or otherwise connected to the core 45, and rotates with the core 45.

A friction washer 61 is located on the outer side of each of the back-up washers 59. The friction washer 61 is not connected to the back-up washer 59, but is allowed to rotated independently.

Outside of each friction washer 61, a second back-up washer 63 is mounted on the bushing 39. This second back-up washer 63 is not connected to the friction washer 61, and does not rotate.

A spring washer 65 is located outside of each of the second back-up washers 63. The spring washer 65 does not rotate.

A tension nut 67 is threaded onto each bushing 39 outside the spring washers 65. Therefore, the roller bearing 49, the back-up washer 59, the friction washer 61, the second back-up washer 63, and the spring washer 65 are held together between the spring back-up washer 57 and the tension nut 67. The tension nut 67 can be rotated to increase or decrease the tension placed on the washers 59, 61, and 65 and the core 45. If the tension is very loose, the core 45 will be free to rotate about the inner race 55.

If the tension is very tight, friction between the friction washer 61 and the back-up washer 59 will slow the rotation of the core 45. As the rotation of the core 45 is slowed, the cover 47 will slip on the surface of the plate cylinder 23, thus wiping the plate cylinder 23 free of foreign particles that might cause a hickey.

Since the bridge roller 21 does not oscillate, this embodiment of the final ink form roller 19' does not need to oscillate. Therefore, there is no need for stops 43 on the shaft 35'.

The form roller of the invention has several advantages over the prior art. The form roller 19 or 19' of the invention wipes the plate cylinder 23 free of foreign particles that might cause hickeys. The tension nut 67 is adjustable to adjust to the environment of the printing press 11. The end result is a better print, with fewer hickeys.

The invention has been described in only two embodiments. It should be apparent to those skilled in the art that the invention is not so limited, but is susceptible to various changes and modifications without departing from the spirit of the invention.

We claim:

1. An improved form roller for a lithographic press having a rotating and oscillating vibrator and a rotating cylindrical plate cylinder, wherein the improved form roller comprises:

a rotating cylindrical core mounted on the press, the longitudinal axis of the core being parallel to the longitudinal axes of the vibrator and the plate cylinder, the core being mounted in contact with the vibrator and with the plate cylinder for transferring ink from the vibrator to the plate cylinder, the core being driven by the vibrator; and a friction washer held against the core with an adjustable tension nut for exerting a resistance against the rotation of the core sufficient to cause the core to rotate slower than the plate cylinder.

2. An improved form roller for a lithographic press having a rotating and oscillating vibrator and a rotating cylindrical plate cylinder, wherein the improved form roller comprises:

a rotating cylindrical core mounted on the press, the longitudinal axis of the core being parallel to the longitudinal axes of the vibrator and the plate cylinder, the core being mounted in contact with the vibrator and with the plate cylinder for transferring ink from the vibrator to the plate cylinder, the core being driven by the vibrator;

resistance means for exerting a resistance against the rotation of the core sufficient to cause the core to rotate slower than the plate cylinder; and a non-rotating shaft mounted between the press and the rotating core of the form roller.

3. A form roller as recited in claim 2, wherein the resistance means comprises a friction washer held against the core with an adjustable tension nut.

4. A form roller as recited in claim 3, further comprising a bushing on the shaft, wherein the tension nut is threaded onto the shaft.

5. A form roller as recited in claim 4, further comprising a backup washer mounted between the tension nut and the friction washer.

6. A form roller as recited in claim 5, further comprising a second backup washer mounted between the friction washer and the core of the form roller.

7. An improved form roller for a lithographic press having a rotating and oscillating vibrator and a rotating cylindrical plate cylinder, wherein the improved form roller comprises:

a rotating cylindrical core mounted on the press, the longitudinal axis of the core being parallel to the longitudinal axes of the vibrator and the plate cylinder, the core being mounted in contact with the vibrator and with the plate cylinder for transferring ink from the vibrator to the plate cylinder, the core being driven by the vibrator;

oscillation means for allowing the core to oscillate with the oscillation of the vibrator;

resistance means for exerting a resistance against the rotation of the core sufficient to cause the core to rotate slower than the plate cylinder; and a non-rotating shaft mounted between the press and the rotating core of the form roller.

8. A form roller as recited in claim 7, wherein the oscillation means comprises a key on the non-rotating shaft and a non-rotating bushing mounted on the shaft for sliding movement along the key.

9. A form roller as recited in claim 8, wherein the resistance means comprises a friction washer held against the core with an adjustable tension nut.

10. A form roller as recited in claim 9, wherein the tension nut is threaded onto the bushing.

11. A form roller as recited in claim 10, further comprising a backup washer mounted between the tension nut and the friction washer.

* * * * *